US005634581A

United States Patent [19]

Taylor

[11] Patent Number: 5,634,581

[45] Date of Patent: Jun. 3, 1997

[54] COMPUTER PAPER EDGE STRIP REMOVER

[76] Inventor: Kevin D. Taylor, 1716 N. 1900 West, Ogden, Utah 84404

[21] Appl. No.: 373,092

[22] Filed: Jan. 17, 1995

[51] Int. Cl.[6] ..... B26F 3/02

[52] U.S. Cl. ..... 225/93; 225/3; 225/98; 400/621.1; D18/34; D18/56

[58] Field of Search ..... 225/3, 91, 93, 225/96.5, 98, 99, 106; 83/574, 856, 912; 30/296.1, DIG. 3, DIG. 8; D3/18; D8/102, 103, 104; D18/34, 56; D19/72; 248/301, 304, 339, 467; 112/285; 400/621.1

[56] References Cited

U.S. PATENT DOCUMENTS

| | | | |
|---|---|---|---|
| 44,389 | 9/1864 | Blake | 30/296.1 |
| 386,749 | 7/1888 | Johnson | 248/304 X |
| 966,931 | 8/1910 | Le Massena | 30/396.1 |
| 1,731,408 | 10/1929 | Finnessy | 248/304 X |
| 2,543,508 | 2/1951 | Rick | 248/304 |
| 2,765,998 | 10/1956 | Engert | 248/467 |
| 5,190,386 | 3/1993 | Eudy | 225/99 X |
| 5,259,543 | 11/1993 | Downing | 225/99 |

FOREIGN PATENT DOCUMENTS

| | | | |
|---|---|---|---|
| WO90/01425 | 2/1990 | WIPO | 83/912 |

*Primary Examiner*—Rinaldi I. Rada
*Assistant Examiner*—Clark F. Dexter
*Attorney, Agent, or Firm*—A. Ray Osburn

[57] ABSTRACT

Devices and associated methods for removing scored edge strips from computer printout sheets. A base member of one device carries an open ended, outwardly opening, channel through which the edge strips and sheets are pulled together to separate the strips by drawing the score line against a tearing plate outstanding centrally within the channel. The tearing plate includes a blunt V-shaped portion to facilitate tearing. The device may be employed to simultaneously remove the edge strips from a single sheet or from a stack of several.

7 Claims, 5 Drawing Sheets

COMPUTER PAPER EDGE STRIP REMOVER

BACKGROUND OF THE INVENTION

1. Field

This invention relates to devices and methods for removing the margin strips from edge driven pages connected for continuous-feed, exemplified by computer printout paper.

2. State of the Art

Computers and word processors often employ edge feed printers in which sprocket wheels engage spaced holes along the edge margins of the paper, as it is fed continuously through the printers. A tear line of small perforations or scores inset from the paper edge defines the margin strip for removal. After printing, the margin strips are no longer of use, and require removal so that the sheets will neatly fit into file folders sized for 8½×11 sheets.

The many sheets of printed output paper are typically folded into thick compact stacks. However, the marginal strips remain very long, and manual tearing along the score lines is laborious, time consuming and irritating. In some instances, the volume of paper is so great as to justify purchase and use of power driven strip removal devices. Such devices are currently available, but are expensive and not justifiable in many installations. Various manual devices of lesser, but still objectional, expense are disclosed in the prior art. One such device is the margin stripper of U.S. Pat. No. 4,521,113, which clamps the edge strips so that the sheets may be manually torn away. This device is large and unwieldy, difficult to hold in the hand during operation so that anchoring to a table or the like is necessary. U.S. Pat. No. 4,754,676 relies upon shearing the margin strip off the printout paper. A quite massive shear plate is required. This device is without a cutting edge, but still poses a danger to fingers caught between shearing and base plates. Another clamping device is disclosed in U.S. Pat. No. 4,675,163. Pegs engage the drive holes to align the paper within the device. It remains unwieldy and requires attachment to a sturdy table or the like for convenient use. Various devices incorporating sharp edge paper cutting blades are disclosed in the prior art. All are inherently dangerous to the fingers of the operators, including the traditional pivoting blade paper cutter. Edge strip removal with this device poses the usual problem of uneven cutting because of shifting of the paper. Letter openers with shielded blades are not adapted to the narrow margin strips. With nothing to guide these strips as they are drawn against the blade, the sharp blade cuts a wandering unpredictable path, rather than cutting along the line of scores.

A need therefore remains for an economical device by which the side strips of computer printout paper may be safely and easily removed manually.

BRIEF SUMMARY OF THE INVENTION

With the foregoing in mind, the shortcomings and disadvantages of prior art methods and devices for removing the scored edge strips from computer printout paper are eliminated or substantially alleviated by the present invention. The strips may be removed from a single sheet at a time, or from several stacked sheets at once, by a single motion manually drawing the paper through the device. The device may be attached anywhere convenient for use, but is typically best utilized with its elongate body member oriented vertically, secured to an upright surface such as the sidewall of a file cabinet or computer housing. The base member preferably has a planar side facing the mounting surface, advantageously carrying mounting adhesive. Outstanding from the base member are a pair of spaced apart wall portions defining with the base member a generally flat bottomed channel the full length of the body.

The inside surfaces of the walls, sloping upwardly and slightly outwardly, and a tear plate outstanding from the center of the channel from its bottom, cooperate to crimp the marginal strip at the score line to form an outwardly opening "V" about said tear plate. The tear plate is cantilevered downwardly from the upper part of the channel bottom. Its innermost edge, sloping downwardly and outwardly, is rounded to tear but not to cut the paper along the score line. The channel walls are advantageously flared to provide widened paper entry at the lowermost, paper inlet, end of the channel and converge smoothly upwardly to a substantially straight narrow portion beginning somewhat below the juncture of the tearing edge with the channel bottom, continuing to the paper outlet, uppermost, end.

The edge strip removal is started by manually tearing along a short, end, portion of the score line. The separated portion is then lifted upwardly into the converging entrance, the converging walls bending the paper at the score line to form the "V" about the tear plate with the score line beneath the tearing edge. Thereafter, the separated end of the strip is gripped with one hand and the printout sheet with the other, and drawn upwardly together through the device to continue the tear the full length of the sheet.

The tearing edge is rounded but blunt, incapable of cutting the paper. A short section near its juncture with the bottom of the channel may be more angular, less blunt, to concentrate the folding and tearing force upon the score line. Also, a pair of opposed small rounded protrusions filleting the junctures of the channel walls and bottom serve to more sharply pinch the fold at the score line, advantageous when only a single sheet is drawn through the device.

In accordance with another embodiment of the invention, the aforesaid channel defining wall portions are eliminated, and the tear plate outstands from an outwardly facing planar surface of the base member. This embodiment, without the paper guiding channel, is somewhat more prone to undesired tearing of the strips or sheet other than along the scored line, but remains efficient and reliable.

It is therefore the object of the invention to provide improved methods and devices for manually removing the tear strips from the sides of computer printout paper.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
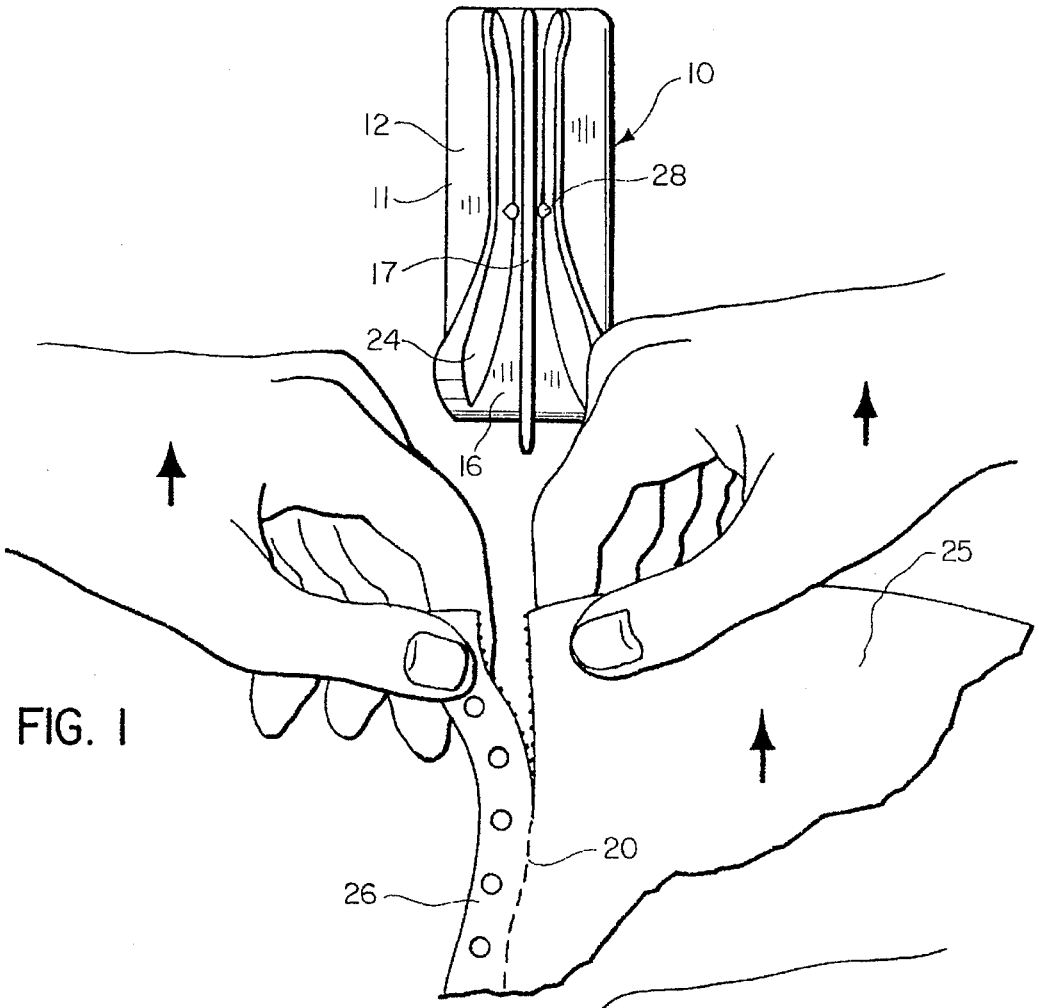
FIG. 1 is a front elevation view of the edge strip removal device of the invention, shown mounted upon a vertical surface, said Figure showing also a fragment of a sheet of computer printout paper with the tear strip thereof being torn away over a short distance from one end thereof, preparatory for insertion into the strip remover, drawn to substantially full scale.

A computer printout sheet edge strip remover 10 in accordance with the invention is illustrated in FIGS. 1–10, the figures being oriented as if the remover was mounted upon a file cabinet wall, for example. Edge stripper 10 comprises a body 11 having a base plate 12 carrying a pair of outstanding wall members 13 and 14, spaced apart to define with base plate 12 a channel 15 with a generally flat bottom 16. Outstanding from base plate 12 centrally to channel 15 is a tearing plate 17, secured as by a tongue and groove 18, best seen in FIG. 8. Tongue and groove 18 positions tearing plate 17 with its downwardly and outwardly angled tearing edge 19 between sidewalls 13 and 14. Tearing edge 19 is bluntly rounded and unable to separate the paper by cutting, assuring separation only along score line 20. (FIGS. 1–3) However, a short less bluntly configured portion 21 near the juncture of edge 19 with the channel bottom crimps the sheet edges more sharply at the score lines, facilitating tearing. Section 21 of edge 19, having no sharp cutting edge, is, like rounded edge 19, also incapable of cutting or otherwise separating the paper except at the score line 20.

Figure 2:
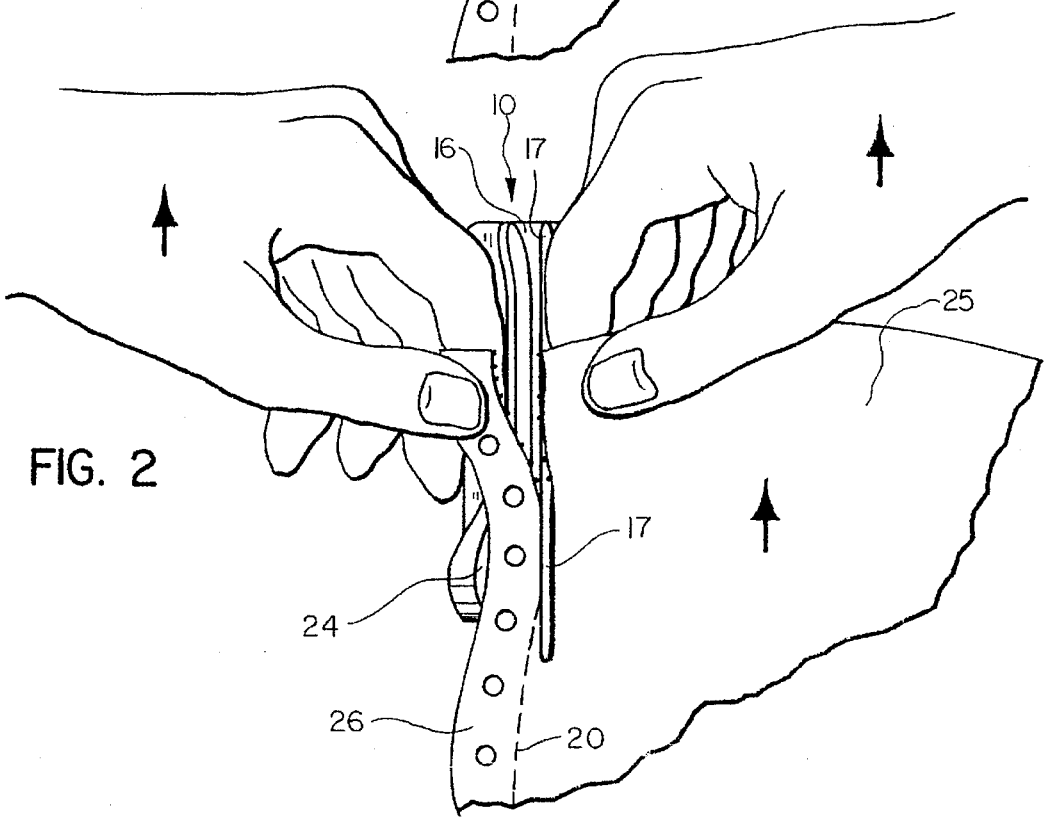
FIG. 2 is a view of the edge strip removing device of FIG. 1 with the computer sheet and tear strip being inserted under the tear plate thereof preparatory to removal from the sheet by simultaneous upward motion of the hands of the operator, drawn to the scale of FIG. 1.
Figure 3:
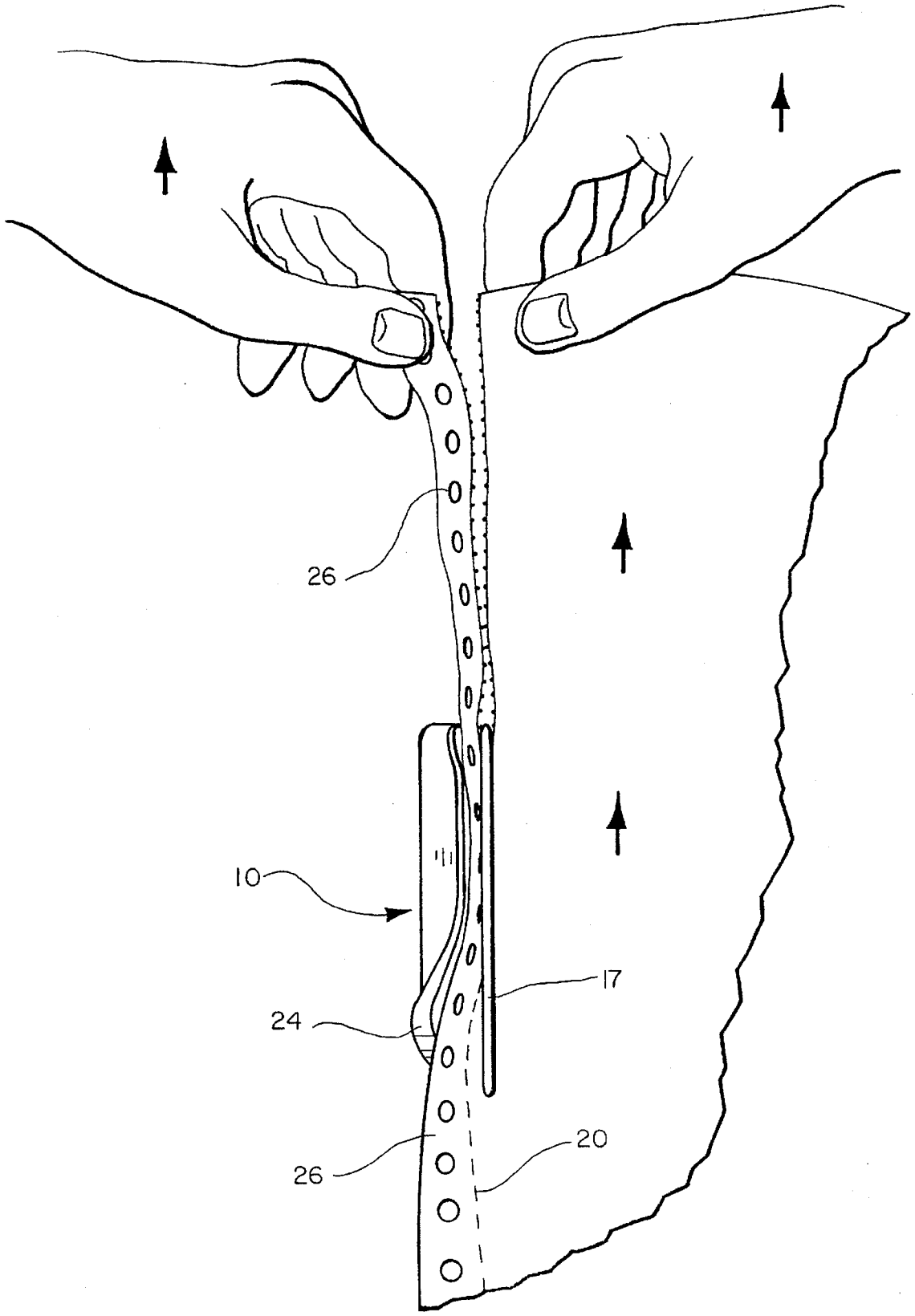
FIG. 3 is still another view of the edge strip remover of FIGS. 1 and 2, with the computer sheet and tear strip shown being separated by being pulled together through the strip remover, drawn to the scale of FIG. 1.
Figure 4:
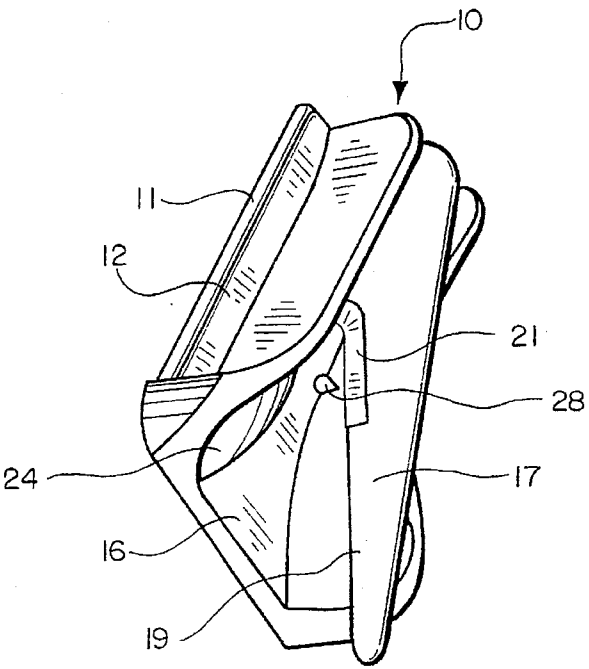
FIG. 4 is a lower left perspective view of the edge strip remover of FIG. 1, drawn to a somewhat larger scale than that of FIG. 1.
Figure 5:
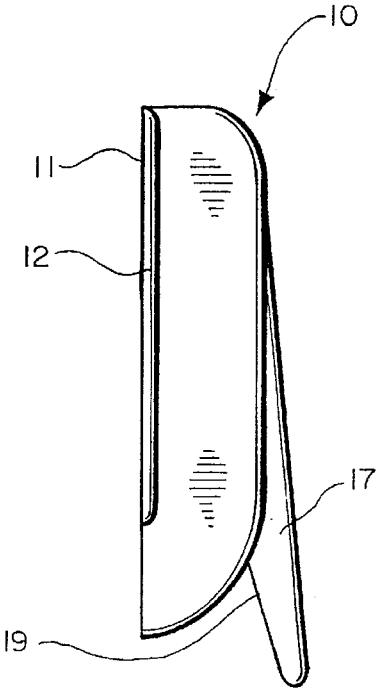
FIG. 5 is a left side elevation view of the edge strip remover of FIG. 1 when mounted upon a vertical surface, drawn to approximately the scale of FIG. 4.
Figure 11:
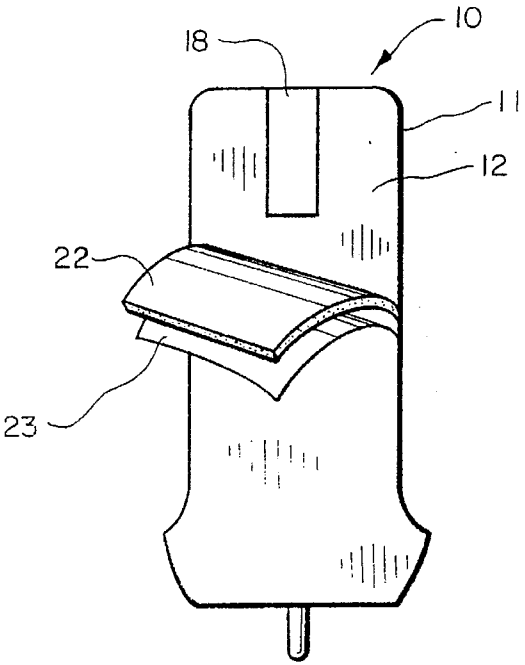
FIG. 11 is a rear elevation view of the edge strip remover of FIG. 6, showing the adhesive plastic coating provided upon the rearmost planar surface for attachment to horizontal or vertical working surfaces, drawn to the scale of FIG. 6.
Figure 6:
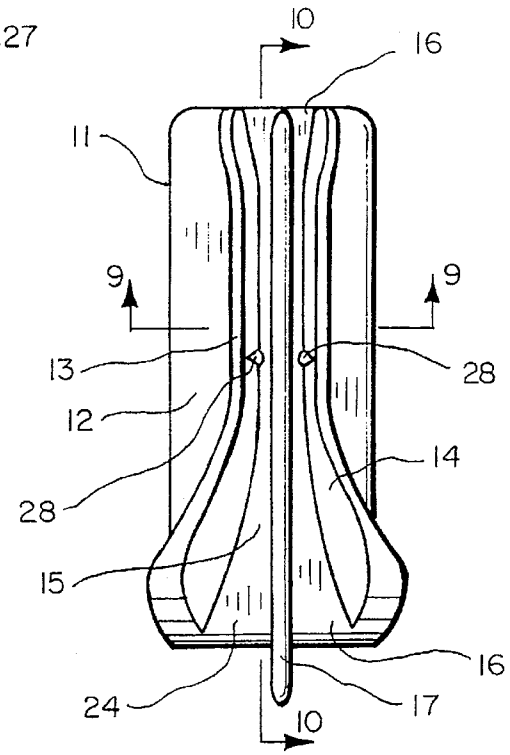
FIG. 6 is another front elevation view of the edge strip remover of FIG. 1, drawn to approximately the scale of FIG. 4.
Figure 7:
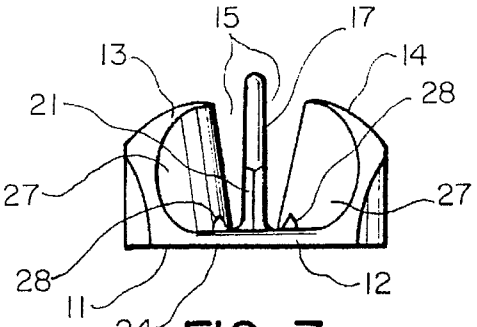
FIG. 7 is a bottom elevation view of the edge strip remover of FIG. 6, drawn to the same scale.
Figure 8:
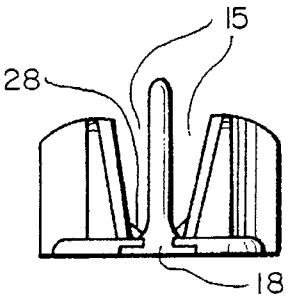
FIG. 8 is a top elevation view of the edge strip remover of FIG. 6, drawn to the same scale.
Figure 9:
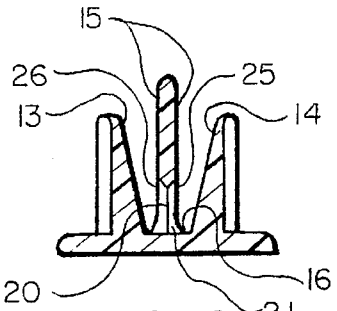
FIG. 9 is a horizontal cross sectional view of the edge strip remover of FIG. 6, taken along line 9—9 thereof, drawn to the same scale, also indicating an edge strip and sheet being drawn therethrough.
Figure 10:
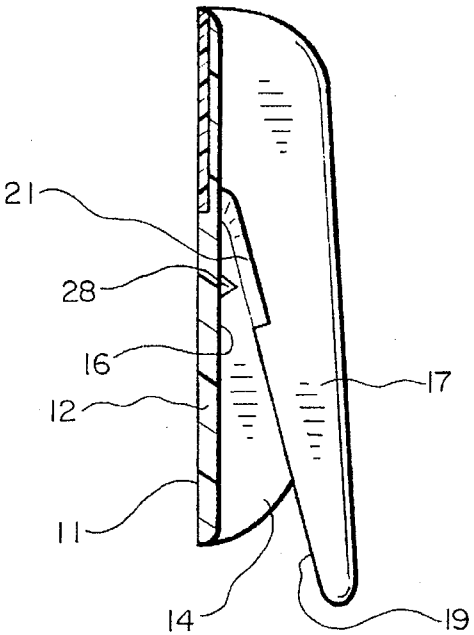
FIG. 10 is a vertical cross sectional view of the edge strip remover of FIG. 6, taken along line 10—10 thereof, drawn to the same scale.
Figure 13:
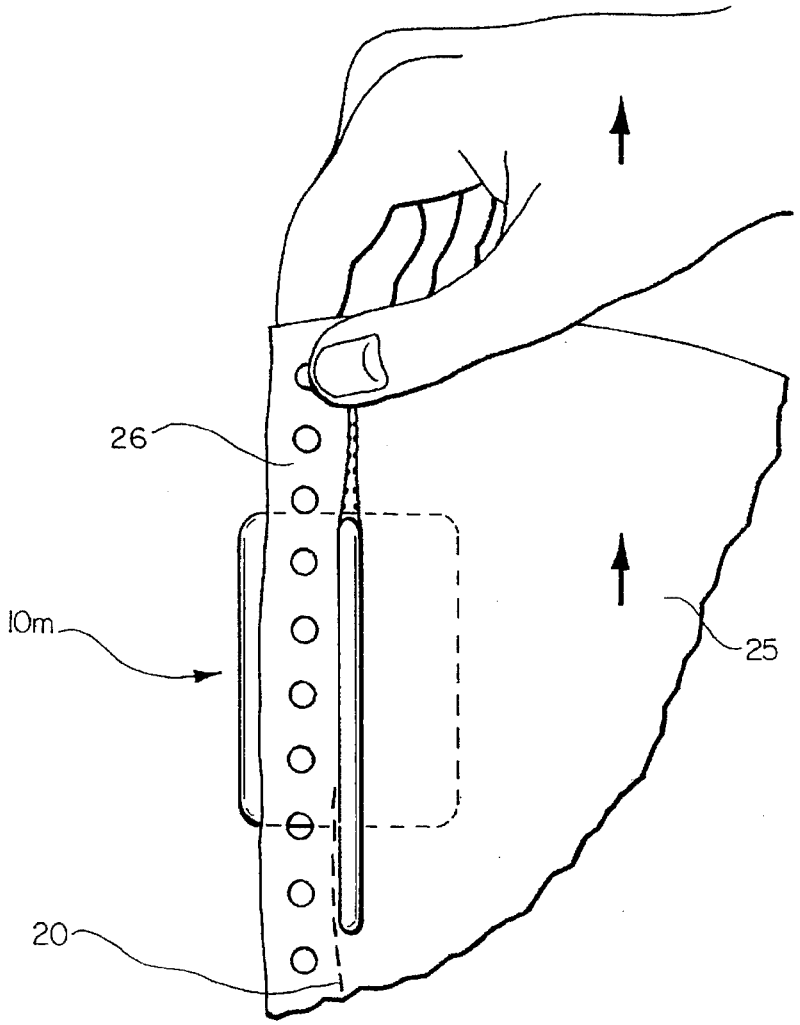
FIG. 13 is a front elevation view of the edge strip remover of FIG. 12 oriented as if mounted upon a vertical surface, showing a fragment of an edge strip being separated from a fragment of a sheet, drawn to the approximate scale of FIG. 12.

As shown in the figures, the preferred mode of use requires stripper 10 to be attached to the vertical side of a computer cabinet or the like. It is advantageous for base plate 12 to carry a layer of adhesive plastic 22 covered by non-adhering paper 23, until attachment to the cabinet wall. (FIG. 11) With edge stripper 10 mounted in this fashion, channel 15 runs vertically, and a flared paper entrance end 24 is positioned lowermost for initial upward insertion of the paper sheet 25. The use of strip remover 10 is illustrated in FIGS. 1–3, showing three stages of the removal. In FIG. 1, computer sheet 25 and removable side strip 26 are manually separated for a short distance downwardly. In FIG. 2, the short separated portion is shown inserted beneath the tearing plate 17, formed into a "V", with score line 20 at its point and generally in line with the tearing edge 19. See also FIG. 9. In FIG. 3, the strip and sheet are drawn together rapidly upwardly through channel 15, being separated along the score line 20 by tear plate 17. Both hands may be used, or the strips and sheets grasped by only one as indicated in FIG. 13. The converging entrance 24, with outwardly and laterally sloping walls 27 continuously fold the paper along tearing line 20 as the sheet and strip are drawn into channel 15. The tear strip 26 and the connected edge portion of sheet 25 are folded outwardly into the "V" shape about tear plate 17. A pair of crimping projections 28 filleting the wall-channel bottom junctures further concentrate the fold upon score line 20. (FIGS. 3 and 9) Progressive folding progressively positions score line 20 beneath tearing edge 19 to progressively separate side strips 26 from sheets 25. The entire strip, or the strips of a stack of sheets, are removed in one smooth upward pull. It has been found that the side strips 26 from a stack of up to ten 8½×11 computer sheets may be removed together in a small fraction of a second.

Several variations in the illustrated embodiment of the strip remover 10 may incorporated without departing from the spirit of the invention. Channel 15 may if desired be molded into a block of plastic, or machined from a metallic block. The illustrated device with tearing plate 17 integrally molded would be functionally equivalent, although difficult to fabricate. The converging entrance promotes efficient use of the invention, but is not essential, and could be replaced with an unflared version. The side strips could be removed even with a channel 15 of unvarying cross section, still with considerable advantages over prior art devices and methods for strip removal.

Figure 12:
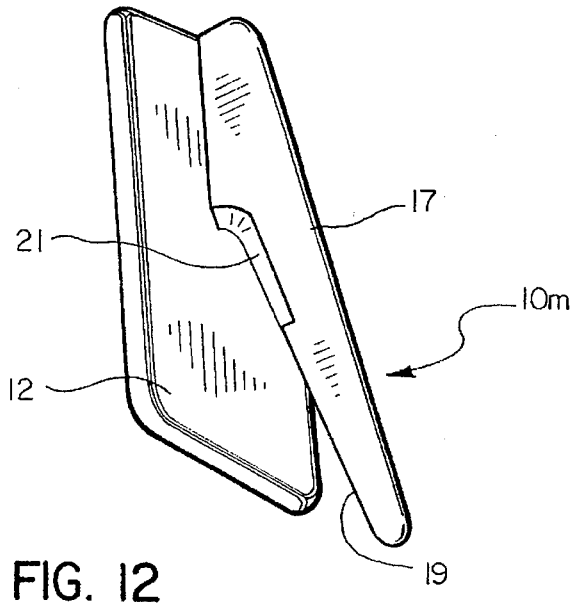
FIG. 12 is a perspective view of another embodiment of an edge strip remover in accordance with the invention, drawn to the approximate scale of FIG. 4.

An embodiment 10 m with no guiding, "V" forming channel 15, as shown in FIGS. 12 and 13, in fact is also within the spirit of the invention, although its use requires somewhat greater skill and care. The safe tearing edge 19 is retained, and continues to separate the strip from the sheet at score line 20, so long as the strips and sheets are pulled reasonably in line with tearing plate 17.

The invention may, therefore exist in other embodiments including these and still others, without departing from the spirit of the invention. The illustrated embodiments therefore are properly to be considered illustrative and not restrictive, with the scope of the invention being put forth in the claims which are intended to embrace all equivalent limitations.

What is claimed and desired to be secured by United States Letters Patent is:

1. An edge strip removing device for manually removing edge drive strips from sheets of flexible paper, the strips each being connected to said sheets through a line weakened for tearing therealong, said device comprising:

an elongate body member symmetrical about a vertical plane of symmetry, having an inwardly facing side and an outwardly facing side, and an outwardly opening channel formed on the outwardly facing side and symmetrical about said vertical plane of symmetry, said channel, extending the full length of the body member and having a generally flat outwardly facing bottom joined by a pair of spaced apart channel sidewall structures each having an inner side facing into the channel, said channel having an uppermost and a lowermost open end;

a tearing plate member symmetrical about said vertical plane of symmetry, having an uppermost portion thereof secured to an uppermost portion of the channel bottom and outstanding therefrom, and a cantilevered portion downwardly extending from said uppermost portion thereof, said cantilevered portion having an a substantially inwardly facing tearing edge sloping outwardly and downwardly from a juncture thereof with the channel bottom, said tearing edge being rounded, and blunt so that the edge strips are torn and not cut from said sheets of flexible paper along said weakened line when said line is pulled thereagainst; and means for securing said inwardly facing side of the body to a vertical mounting surface.

2. The edge strip removing device of claim 1, wherein:

the inner sides of the channel sidewall structures diverge outwardly and laterally, so that the edge strips and adjacent portions of the sheets are bent at the tear line into an outwardly-opening "V" shape about the tear plate when the strips and sheets are drawn simultaneously upwardly through the channel on opposite sides of said tear plate.

3. The edge strip removing device of claim 2, wherein:

each channel sidewall structure has a lowermost portion, and the lowermost portions of the channel sidewall structures diverge downwardly and laterally to the lowermost open end of the channel.

4. The edge strip removing device of claim 3, further comprising:

a pair of opposed paper crimping projections disposed inwardly of the tearing edge, each filleting a portion of a juncture between the flat bottom and a respective one of the channel sidewall structures.

5. The edge strip removing device of claim 2, further comprising:

a pair of opposed paper crimping projections disposed inwardly of the tearing edge, each filleting a portion of a juncture between the flat bottom and a respective one of the channel sidewall structures.

6. The edge strip removing device of claim 5, wherein:

at least a portion of the tearing edge is in the shape of a "V" beginning at the juncture of said tearing edge with the channel bottom.

7. The edge strip removing device of claim 2, wherein:

at least a portion of the tearing edge is in the shape of an inwardly converging "V" beginning at the juncture of said tearing edge with the channel bottom.

* * * * *